US006004506A

United States Patent [19]

Chu et al.

[11] Patent Number: 6,004,506

[45] Date of Patent: Dec. 21, 1999

[54] ALUMINUM PRODUCTS CONTAINING SUPERSATURATED LEVELS OF DISPERSOIDS

[75] Inventors: Men Glenn Chu, Export; Gregory J. Hildeman, Murrysville, both of Pa.

[73] Assignee: Aluminum Company of America, Pittsburg, Pa.

[21] Appl. No.: 09/033,132

[22] Filed: Mar. 2, 1998

[51] Int. Cl.[6] ..... C22C 21/00

[52] U.S. Cl. ..... 420/552; 420/553

[58] Field of Search ..... 420/552, 553

[56] References Cited

U.S. PATENT DOCUMENTS

| | | | |
|---|---|---|---|
| 3,634,075 | 1/1972 | Hoff | 75/135 |
| 4,040,468 | 8/1977 | Nieman | 164/55 |
| 4,082,578 | 4/1978 | Evancho et al. | 148/12.7 |
| 4,107,393 | 8/1978 | Frantzreb, Sr. et al. | 428/558 |
| 4,629,505 | 12/1986 | Paris | 75/228 |
| 4,661,172 | 4/1987 | Skinner et al. | 148/12.7 |
| 4,834,810 | 5/1989 | Benn et al. | 148/437 |
| 4,834,942 | 5/1989 | Frazier et al. | 420/552 |
| 5,049,211 | 9/1991 | Jones et al. | 148/437 |
| 5,066,457 | 11/1991 | Jones et al. | 420/552 |
| 5,067,994 | 11/1991 | Brubak et al. | 148/415 |
| 5,318,641 | 6/1994 | Masumoto | 148/403 |
| 5,484,493 | 1/1996 | Young et al. | 148/437 |
| 5,624,632 | 4/1997 | Baumann et al. | 420/544 |
| 5,900,210 | 5/1999 | Büchler et al. | 420/548 |

FOREIGN PATENT DOCUMENTS

| | | |
|---|---|---|
| 7003410 | 1/1995 | Japan . |

*Primary Examiner*—Daniel J. Jenkins
*Attorney, Agent, or Firm*—David W. Pearce-Smith

[57] ABSTRACT

An aluminum alloy containing dispersoid-forming elements selected from the group consisting of Zr, Mn, Cr, V, Hf, Ti, Nb, Y, Sc and combinations thereof. The improved alloy comprises the dispersoid-forming elements partially in solid solution above the saturation limit and partialy in a form of aluminide particles having an average particle size of less than 1 micron.

32 Claims, 2 Drawing Sheets

ALUMINUM PRODUCTS CONTAINING SUPERSATURATED LEVELS OF DISPERSOIDS

TECHNICAL FIELD OF THE INVENTION

This invention relates to the addition of alloying elements to aluminum alloys. More particularly, it relates to methods of adding alloying elements to molten aluminum to maintain high levels in solid solution.

BACKGROUND OF THE INVENTION

In the aluminum industry, dispersoid-forming elements such as Zr, Mn, Cr, V, Ti, Sc and Hf are used to increase recrystallization temperature and to control the grain structure in cast and wrought products. Many different methods have been employed to add these types of alloying elements to molten metals. Typically, master alloys which contain the desired elements are added directly to the melt in the forms of a cast lump, bar, waffle or added as briquettes composed of mixtures of aluminum and elemental powders or chips.

The alloying elements in the master alloys are normally present in a form of coarse intermetallics such as for example $Al_3Zr$. These intermetallics require superheat and a long period of holding time to be dissolved in the melt. The heavy intermetallics also tend to settle to the bottom of the holding furnace due to gravity. Thus, master alloys are generally added in the melting or holding furnace to allow sufficient time for the intermetallics to dissolve in the superheated melt which is occasionally stirred.

In addition, the level of these desirable dispersoid-forming elements in the commercial aluminum alloys has been limited to the liquid solubility at peritectic reaction temperature. For example, in the case of aluminum binary systems, the maximum liquid solubility of Zr, Cr, V and Hf is 0.12, 0.37, 0.2 and 0.2 wt. %, respectively. In commercial aluminum alloys, these maximum limits of liquid solubility at peritectic temperatures will be reduced even further. Casting of aluminum alloys containing dispersoid elements at levels above their natural saturation limit can result in formation of undesirable coarse primary intermetallics in the molten metal.

If coarse intermetallics are not filtered out of the molten metal, they will adversely affect the ability to cast the metal as well as the mechanical properties of the end product by reducing ductility, fracture toughness, or fatigue properties. Since coarse primary intermetallics can rapidly nucleate and grow in melts which exceed the maximum solubility limit, the conventional alloying approach is to add dispersoid-forming elements in the melting or holding furnace in amounts below the liquid saturation limit.

It would be highly desirable to form metal which has been cast such that it contains dispersoid-forming elements at a level greater than the liquid solubility limit of the elements. Supersaturated levels of dispersoid-forming elements in solid solution will increase the number of nucleation sites which form fine dispersoids during preheating of the cast alloy, which enables the recrystallization temperature to be increased, and inhibits grain growth during hot working.

For structural applications, a fine grain unrecrystallized microstructure has a better combination of strength, elongation and toughness than a coarse grain recrystallized alloy. Metallurgically, a high volume fraction of fine dispersoids which are less than about 0.1 microns in size are useful for retaining a fine grain unrecrystallized microstructure.

Currently the volume fraction of dispersoids which can be formed is limited by the liquid solubility of the dispersoid-forming elements in the alloy.

It is against this background that the present invention was made.

Accordingly, it is a principal object of this invention to provide aluminum alloys having high levels of fine dispersoids.

It is a further object of the present invention to provide a method for increasing the amount of dispersoid-forming elements in solid solution which is not limited to the liquid solubility level.

Another object of the invention is to provide a method to increase the volume fraction of dispersoids formed by precipitating from a supersaturated solid solution.

Yet another object of the present invention is to provide a method for casting aluminum alloys with supersaturated levels of dispersoid-forming elements.

Yet it is another object of this invention to provide aluminum alloys having levels of Zr greater than about 0.12 wt. %.

Yet it is another object of this invention to provide aluminum alloys having levels of Mn greater than about 2.06 wt. %.

Yet it is another object of this invention to provide aluminum alloys having levels of Cr greater than about 0.37 wt. %.

Yet it is another object of this invention to provide aluminum alloys having levels of V greater than about 0.2 wt. %.

Yet it is another object of this invention to provide aluminum alloys having levels of Ti greater than about 0.14 wt. %.

Yet it is another object of this invention to provide aluminum alloys having levels of Hf greater than about 0.20 wt. %.

Yet it is another object of this invention to provide aluminum alloys having levels of Y greater than about 0.16 wt. %.

Yet it is another object of this invention to provide aluminum alloys having levels of Nb greater than about 0.016 wt. %.

Yet it is another object of this invention to provide aluminum alloys having levels of Sc greater than about 0.47 wt. %

It is a further object of this invention to provide a method for casting aluminum alloys having levels of dispersoid-forming elements in solid solution greater than the liquid solubility limits.

These and other objects and advantages of the present invention will be more fully understood and appreciated with reference to the following description.

SUMMARY OF THE INVENTION

In accordance with these objects, there is provided a process of achieving a high level of dispersoid-forming elements in solidified aluminum alloys by the addition of a supersaturated master alloy to a molten aluminum alloy which is immediately solidified. The process comprises (a) forming a supersaturated master alloy containing dispersoid-forming elements in solid solution by rapidly solidifying a master alloy containing at least one dispersoid-forming element; (b) providing a body of molten aluminum alloy; (c) adding said rapidly solidified master alloy to the molten aluminum alloy at a rate sufficient to raise the wt. % of at least one dispersoid-forming element above its liquid saturation limit; and then (d) solidifying the molten aluminum alloy to form a solidified aluminum alloy possessing dispersoid-forming elements in solid solution above the liquid saturation limit.

A second aspect of the invention is a cast metal product in which the level of dispersoid-forming elements in solid solution is greater than the liquid saturation limit of the elements. In a preferred embodiment, metal product is an aluminum alloy and the dispersoid-forming elements are zirconium (Zr), manganese (Mn), chromium (Cr), vanadium (V), titanium (Ti), scandium (Sc), niobium (Nb), yttrium (Y) and hafnium (Hf).

BRIEF DESCRIPTION OF THE DRAWINGS

Other features of the present invention will be further described in the following related description of the preferred embodiment which is to be considered together with the accompanying drawings wherein like figures refer to like parts and further wherein.

DEFINITIONS

The term "master alloy" is used herein to mean an aluminum base alloy in remelt ingot form containing at least 50% aluminum and one or more added elements for use in making alloying additions. The term master alloy is also used interchangeably in the art with the terms "rich alloy" and "hardener".

The term "dispersoid-forming elements" is used herein to mean alloy elements that precipitate from solid solution to form intermetallic dispersoids in a base alloy. Examples of dispersoid-forming metals for aluminum alloys include, but are not limited to, manganese (Mn), zirconium (Zr), chromium (Cr), vanadium (V), titanium (Ti), scandium (Sc), hafnium (Hf), yttrium (Y) niobium (Nb) and combinations thereof.

The term "rapidly solidified" is used herein to mean cooled from a liquid state into a solid state at rate of greater than about 100° C. per second or preferably greater than about 1000° C. per second. Rapidly solidified materials are preferably formed in the shape of thin ribbon, powder and flakes.

The term "coarse" as it refers to intermetallic particles formed from liquid solution is a particle being greater than about 5 microns.

The term "fine" as it refers to intermetallic dispersoid particles which are precipitated from solid solution is a particle being less than about 0.1 microns.

The term "continuous" as used herein refers to the progressive and uninterrupted formation of a cast metal ingot in a mold which is open at both ends. The pouring operation may continue indefinitely if the casting is cut into sections of suitable length at a location away from the mold. Alternatively, the pouring operation may be started and stopped in the manufacture of each casting. The latter process is commonly referred to as semi-continuous casting and is intended to be comprehended by the term "continuous".

DETAILED DESCRIPTION OF THE INVENTION

Figure 1:
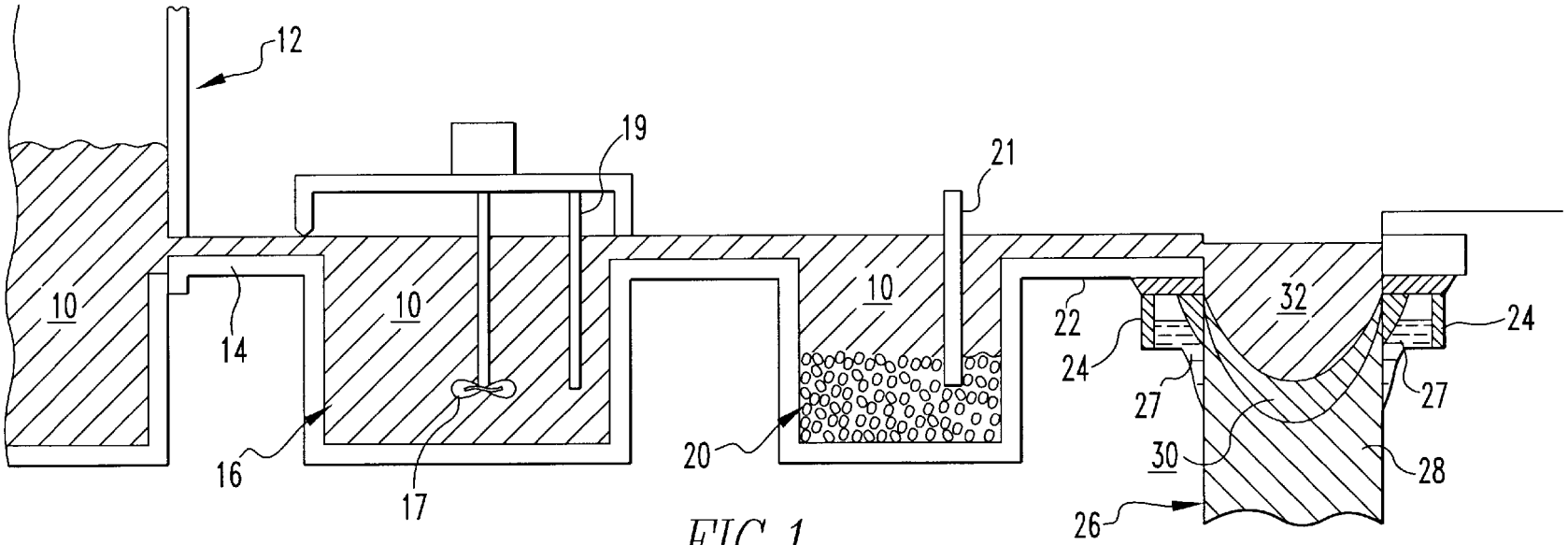
FIG. 1 is a view of the flow of metal from a furnace to the casting pit.

Referring first to FIG. 1, there is illustrated a typical flow path for molten metal 10 from a furnace 12 to the casting mold 24 used for continuously casting ingots.

Typically, molten metal 10 is held at superheated temperatures in furnace 12. Alloying elements are typically added to furnace 12. Some of the alloying elements are added to the melt using master alloys that have high concentrations of alloying elements, that is, 10–15%. These alloying elements are normally present in a form of coarse intermetallics. These intermetallics require a long holding time in furnace 12 to be dissolved in the melt. The melt must also be stirred since the heavy intermetallics tend to settle to the bottom of the holding furnace due to gravity.

Typically, metal 10 is held in furnace 12 for several hours. During this time, coarse intermetallics are dissolved in the melt to form a liquid solution. Molten metal leaves furnace 12 via trough 14 and enters fluxing unit 16 to remove hydrogen, calcium and sodium by gas fluxing.

Flux unit 16 has impeller 17 for dispensing a flux gas. Impeller 17 is mounted on shaft 18. Impeller 17 is rotated, and simultaneously with the rotating, a fluxing gas is added to the molten aluminum adjacent the dispenser. Flux units are well known in the art.

After the molten metal travels beneath baffle 19, it then passes through a filter 20 under baffle 21 as it flows via trough 22 to casting mold 24 to form, in this case, ingot 26.

Mold 24 is a conventional direct chill casting apparatus and may be internally cooled, usually with a liquid coolant 27 such as water. Mold 24 is typically constructed of a material having high thermal conductivity, such as aluminum or copper, to insure that the coolant temperature is transferred as efficiently as possible through the inner mold wall to the metal to effect solidification.

Ingot 26 has a lower solidified section 28, a mushy region 30 and a molten pool 32 of aluminum above. Molten metal pool 32 is supported by mold 24 incorporating cooling liquid 27. Molten aluminum 12 is flowed to molten pool 32, and solidified ingot section 28 is removed from mold 24 at a controlled rate by the lowering of a bottom block (not shown).

For certain alloying elements, such as dispersoid-forming elements, it is desirable to add such elements to the melt in a manner to form a liquid solution. Heretofore, this has been accomplished by:

1. adding the master alloys containing dispersoid-forming elements to superheated molten metal in melting furnace 12 where they have time to dissolve and be held in solution, and
2. limiting the concentration of the dispersoid-forming elements being added to molten metal 10 to levels below their natural saturation limit to avoid the formation of coarse intermetallics.

If dispersoid-forming elements are added to the melting furnace above their saturation limit in accordance with conventional alloying practices, they can form coarse primary aluminide intermetallic particles in the liquid which become trapped in the solidified metal. These coarse intermetallics could adversely affect the mechanical properties of the wrought product. Therefore, care has always been taken to limit the total concentration of the dispersoid-forming elements to avoid any negative impact on the resulting properties of the wrought product.

Surprisingly, Applicants have found that dispersoid-forming elements can be added to the molten metal at levels above the natural solubility limit for the alloy without forming coarse primary aluminide intermetallic particles.

Unexpectedly, Applicants have discovered that if dispersoid-forming elements are added directly to molten pool 32 at levels which form melts having supersaturated levels of dispersoid-forming elements, the resulting solidified metal does not contain coarse intermetallic particles which adversely affect the mechanical properties of the solidified metal.

Figure 2:
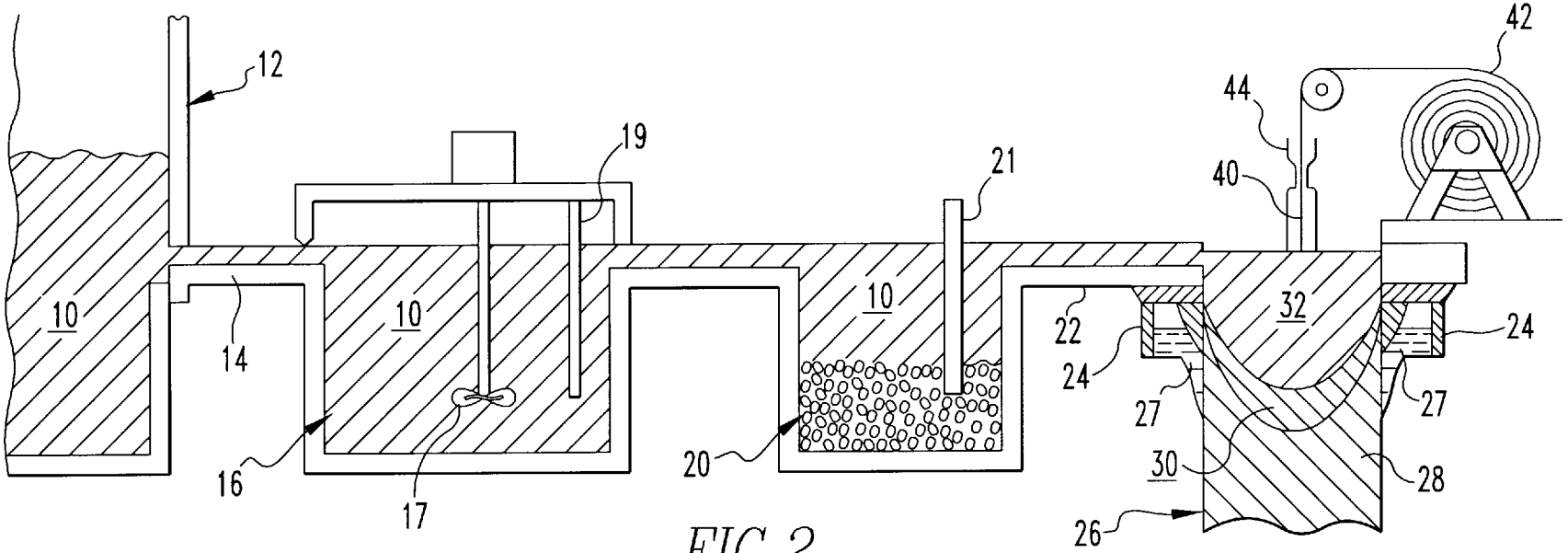
FIG. 2 is an enlarged view of the casting facility of FIG. 1.

FIG. 2 shows a rapidly solidified ribbon 40 of the material containing a dispersoid-forming element being added directly into molten metal pool 32 of ingot 26. Ribbon 40 is fed from spool 42 into a fixture 44 for directing the ribbon into the molten pool. The residence time between melting of ribbon 40 and solidification of the supersaturated alloy contained in molten metal pool 32 is sufficiently short as to permit dissolution of the master alloy ribbon containing at least one dispersoid-forming element in solid solution and subsequent freezing of the molten metal at the bottom of the crater without growing into larger particles, thereby maintaining high levels of dispersoid-forming elements in solid solution in the solidified ingot.

Due to natural convection in the molten metal pool 32, the supersatured liquid solution which is produced by the dispersoid-forming element is distributed uniformly in the pool of molten aluminum. The residence time of the dispersoid-forming element in the crater is short since the metal is immediately solidified into ingot. If it is desired to add the dispersoid-forming element zirconium, the ribbon may be comprised of 2.0 wt. % Zr or higher, the remainder aluminum. The feed rate of the ribbon can be controlled to provide the desired amount of Zr in the ingot. Further, when the ribbon is formed from a melt of aluminum and zirconium, it may be cast onto a roll or drum where fast solidification occurs to freeze Zr in the aluminum ribbon as a solid solution. Methods for making the rapidly solidified ribbon are known to the art.

To achieve a concentration of dispersoid-forming element above the liquid saturation limit, two factors must be kept in mind.

1. First, the dispersoid-forming element(s) is added to the liquid metal in a form in which the dispersoid-forming element is in solid solution.
2. Second, the dispersoid-forming element(s) is added at a location close to the crater of the ingot such that the melt is quickly solidified to reduce residence time of the supersatured liquid in the crater of the ingot. Since the dispersoid-forming element(s) is added at a concentration above the natural saturation point, a long residence time will result in the formation of coarse particles in the molten metal.

The benefit of the present invention is illustrated in the following example.

EXAMPLE

Melt spun ribbon having a composition of Al-6% Zr was formed using standard rapid solidification techniques. The ribbon was 0.009 inch thick and 1 inch wide. The ribbon was continuously fed into a pool of molten alloy 7150 at the casting head of a DC ingot. The ribbon was added to the melt at rate of 1000 inches per minute.

The 7150 alloy from the furnace had a Zr level of just below its natural solubility limit of 0.12% to avoid formation of coarse Zr intermetallics in the ingot. The continuous addition of the ribbon to the molten melt in the pool enables the Zr concentration to be increased above the solubility limit. After casting, the ingot was analyzed and the level of Zr in the cast ingot was measured to be at 0.21%.

Surprisingly, there were no coarse intermetallic particles in the ingot, indicating that Zr is saturated in the solid solution. This was unexpected since in prior art casting techniques, coarse intermetallics of zirconium aluminide form when the level of zirconium is above the natural saturation limit.

Unexpectedly, the as-cast grain size of the ingot was found to be approximately 5 times smaller than the grain size of AA7150 ingot containing Zr levels approaching its natural solubility limit of 0.12%.

It is to be appreciated that certain features of the present invention may be changed without departing from the present invention. Thus, for example, it is to be appreciated that although the invention has been described in terms of added Zr to aluminum at levels of 0.21%, it is not intended to be so limited. Greater amounts of the Zr could be added if higher feed rates, larger ribbons, or multiple ribbons were used to add Zr to the molten metal.

Whereas the preferred embodiments of the present invention have been described above in terms of being especially valuable in formation of supersatured levels of Zr in aluminum, it will be apparent to those skilled in the art that the same technique can be use for other elements. Thus for example, the same technique can be used to create supersatured levels of manganese, chromium, vanadium, titanium, scandium, hafnium, yttrium, niobium, and combinations thereof.

Whereas the preferred embodiments of the present invention have been described above in terms of the supersatured levels of zirconium in aluminum, it will be apparent to those skilled in the art that the present invention will be useful for other metals. Metals suitable for use with the present invention are not limited to aluminum and aluminum alloys. Objects formed from other metals such as magnesium, copper, iron, zinc, nickel, cobalt, titanium, and alloys thereof may also benefit from the present invention.

Whereas the preferred embodiments of the present invention have been described above in terms of continuous casting of aluminum, it will be apparent to those skilled in the art that the present invention will be useful in other casting methods. The terms "metal casting" and "solidifying" are intended to include metal casting techniques used in any of the commercial solidification processes, including continuous casting semi-continuously casting by the direct chill method, as well as strip or slab cast continuously by belts, block or roll casters. In addition, the invention may be used in other solidification processes such as spray forming, spray casting, atomization, rapid solidification, and splating.

Whereas the preferred embodiments of the present invention have been described above in terms of being especially valuable in producing aluminum alloy 7150, it will be apparent to those skilled in the art that the present invention will also be valuable in producing products made of other aluminum alloys containing about 75% or more by weight of aluminum and one or more alloying elements. Among such suitable alloying elements is at least one element selected from the group of essentially character-forming alloying elements consisting of manganese, zinc, lithium, copper, silicon, and magnesium. These alloying elements are essentially character forming for the reason that the contemplated alloys containing one or more of them essentially derive their characteristic properties from such elements. Usually, the amounts of each of the elements which impart such characteristics are, as to each of magnesium and copper, about 0.5 to about 10 wt. % of the total alloy if the element is present as an alloying element in the alloy; as to the element zinc, about 0.05 to about 12.0% of the total alloy if such element is present as an alloying element; as to the element lithium, about 0.2 to about 3.0% of the total alloy if such element is present as an alloying element; and as to the element manganese, if it is present as an alloying element, usually about 0.15 to about 2.0% of the total alloy.

The elements iron and silicon, while perhaps not entirely or always accurately classifiable as essentially character-forming alloy elements, are often present in aluminum alloys in appreciable quantities and can have a marked effect upon the derived characteristic properties of certain alloys containing the same. Iron, for example, which if present and generally considered as an undesired impurity, is sometimes desirably adjusted in amounts of about 0.3 to 2.0 wt. % of the total alloy to perform specific functions in certain alloys. Silicon may also be so considered, and while found in a range varying from about 0.05 to as much as 20% in casting alloys, is desirably added in the range of about 0.3 to 1.5% to perform specific functions in certain alloys. In light of the foregoing dual nature of these elements and for convenience of definition, the elements iron and silicon may, at least when desirably present in character-affecting amounts in certain alloys, be properly also considered as character-forming alloying ingredients.

The aluminum alloys included most preferably the wrought and forged aluminum alloys such as those registered with the Aluminum Association by the designations 2011, 2014, 2017, 2117, 2218, 2616, 2219, 2419, 2519, 2024, 2124, 2224, 2025, 2036, 4032, 5052, 5056, 5083, 5086, 5154, 5252, 5356, 5456, 5556, 5562, 56546101, 6201, 6009, 6010, 6111, 6013, 6151, 6351, 6951, 6053, 6060, 6022, 6061, 6262, 6063, 6066, 6070, 7001, 7005, 7010, 7016, 7021, 7029, 7049, 7050, 7150, 7055, 7075, 7175, 7475, 7076, 7178, 8090 and other appropriate alloys of similar designation. Of particular interest are the aluminum alloys 2014, 2024, 6061, 7050, 7150, 7055 and 7075. These aluminum alloys generally include the generic designation 2000 series alloys, 5000 series alloys, 6000 series alloys, 7000 series alloys, and 8000 series alloys.

It is also to be appreciated that although the invention has been described in terms of cast alloy, the method and apparatus of the present invention may also be employed with casting metal matrix composites, semi-solid alloys, metal laminates, and cermets.

Whereas the preferred embodiments of the present invention have been described above in terms of adding the master alloy containing dispersoid-forming elements directly into the crater of an aluminum ingot as it is being cast, it will be apparent to those skilled in the art that the master alloy containing dispersoid-forming elements can be added in or near the solidification zone in other casting methods.

It is also to be appreciated that although the invention has been described in terms alloying directly into the pool of molten metal in the head of an ingot as it is being cast, the present invention is not intended to be so limited. Those skilled in the art will recognize that the location of adding alloying additions of dispersoid-forming elements is not critical to practicing the invention. For example, dispersoid-forming elements may also be alloyed into the molten metal in the trough adjacent the ingot that is being cast. The key is to alloy the dispersoid-forming element above the liquid saturation limit at a point in the process where there is insufficient time for the dispersoid-forming element to form large particles in the solidified metal.

In addition, although the invention has been described in terms of alloying a single dispersoid-forming element at supersatured levels, it will be apparent to those skilled in the art that the same technique can be use for creating a product with multiple dispersoid-forming elements at supersatured levels. Thus for example, the same technique can be used to create supersatured levels of any combination of manganese, chromium, vanadium, titanium, scandium, hafnium, yttrium, niobium, and zirconium.

Although the invention has been described in terms of casting ingot, the invention is not intended to be so limited and applies to all forms of casting. The invention is intended to be equally applicable to products such as sheet, plate, wire, rod, bar, forging or extrusions. It is contemplated that the invention will be especially useful for tubular sporting goods products such as ball bats, lacrosse sticks, hockey sticks, polo sticks, field hockey sticks, ice hockey sticks, pool cues, arrows, gun scopes, wind surfing frames, sail board booms, inline skate components, wheelchairs, golf club shafts, bicycle frames and components such as handlebars, seat posts and suspension systems, ski poles, javelins, bowling pins and the like.

Further examples of applications of the improved products are vehicular panels. Vehicular panels are described in U.S. Pat. No. 4,082,578, incorporated herein by reference, and include floor panels, side panels, or other panels for cars, trucks, trailers, railroad vehicles and canoe or boat panels, aerospace panels and other shaped sheet and extrusion members, forgings and other members such as, for example, drive shafts.

Other examples of applications of the improved products are structural members including shipping pallets and containers made by shaping sheet, forging or extrusion members and riveting or welding the assemblies together. The improved aluminum extrusion, pipe and tube stock made in accordance with the present invention will be especially useful in automotive and aerospace applications. The aerospace applications include airplane wing and fuselage structural members such as, for example, stringer extrusions.

Many other applications of the improved products present themselves in view of the herein set forth advantages of the invention.

What is believed to be the best mode of the invention has been described above. However, it will be apparent to those skilled in the art that these and other changes of the type described could be made to the present invention without departing from the spirit of the invention. The scope of the present invention is indicated by the broad general meaning of the terms in which the claims are expressed.

What is claimed is:

1. In an aluminum alloy containing dispersoid-forming elements selected form the group consisting of Zr, Mn, Cr, V, Hf, Ti, Nb, Y, Sc and combinations thereof, the improvement comprising:

said dispersoid-forming elements in solid solution above their liquid saturation limit.

2. The aluminum alloy of claim 1 in which said dispersoid-forming element is Zr and contains at least about 0.12 wt. % Zr in solid solution.

3. The aluminum alloy of claim 1 in which said dispersoid-forming element is Mn and contains at least about 2.06 wt. % Mn in solid solution.

4. The aluminum alloy of claim 1 in which said dispersoid-forming element is Cr and contains at least about 0.37 wt. % Cr in solid solution.

5. The aluminum alloy of claim 1 in which said dispersoid-forming element is V and contains at least about 0.2 wt. % V in solid solution.

6. The aluminum alloy of claim 1 in which said dispersoid-forming element is Ti and contains at least about 0.2 wt. % Ti in solid solution.

7. The aluminum alloy of claim 1 in which said dispersoid-forming element is Hf and contains at least about 0.2 wt. % Hf in solid solution.

8. The aluminum alloy of claim 1 in which said dispersoid-forming element is Y and contains at least about 0.16 wt. % Y in solid solution.

9. The aluminum alloy of claim 1 in which said dispersoid-forming element is Nb and contains at least about 0.16 wt. % Nb in solid solution.

10. The aluminum alloy of claim 1 in which said dispersoid-forming element is Sc and contains at least about 0.47 wt. % Sc in solid solution.

11. An aluminum alloy containing dispersoid-forming elements selected form the group consisting of Zr, Mn, Cr, V, Hf, Ti, Nb, Y, Sc and combinations thereof, the improvement comprising:

supersaturated levels of said dispersoid-forming elements.

12. The aluminum alloy of claim 11 in which said aluminum alloy is a 1000 series alloy.

13. The aluminum alloy of claim 11 in which said aluminum alloy is a 2000 series alloy.

14. The aluminum alloy of claim 11 in which said aluminum alloy is a 3000 series alloy.

15. The aluminum alloy of claim 11 in which said aluminum alloy is a 5000 series alloy.

16. The aluminum alloy of claim 11 in which said aluminum alloy is a 6000 series alloy.

17. The aluminum alloy of claim 11 in which said aluminum alloy is a 7000 series alloy.

18. The aluminum alloy of claim 11 in which said aluminum alloy is a 8000 series alloy.

19. An aluminum alloy recreational product containing dispersoid-forming elements selected form the group consisting of Zr, Mn, Cr, V, Hf, Ti, Nb, Y, Sc and combinations thereof, the improvement comprising:

supersaturated levels of said dispersoid-forming elements.

20. The aluminum alloy recreational product of claim 19 in which said recreational products are selected from the group consisting of ball bats, lacrosse sticks, hockey sticks, polo sticks, field hockey sticks, ice hockey sticks, pool cues, arrows, gun scopes, wind surfing frames, sail board booms, inline skate components, wheelchairs, golf club shafts, bicycle frames and components ski poles, javelins and bowling pins.

21. An aluminum alloy vehicular panel product containing dispersoid-forming elements selected form the group consisting of Zr, Mn, Cr, V, Hf, Ti, Nb, Y, Sc and combinations thereof, the improvement comprising:

supersaturated levels of said dispersoid-forming elements containing fine primary intermetallics.

22. The aluminum alloy vehicular panel product of claim 21 in which said vehicular panel product is selected from the group consisting of floor panels, side panels, or other panels for cars, trucks, trailers, railroad vehicles and canoe or boat panels, aerospace panels and other shaped sheet and extrusion members, forgings and other members.

23. In an aluminum alloy containing dispersoid-forming elements selected from the group consisting of Zr, Mn, Cr, V, Hf, Ti, Nb, Y, Sc and combinations thereof, the improvement comprising:

said dispersoid-forming elements partially in solid solution above the saturation limit and partially in a form of aluminide particles having an average particle size of less than 1 micron.

24. The aluminum alloy of claim 23 in which said dispersoid-forming element is Zr and said dispersoid-forming element contains at least 0.12 wt. % Zr.

25. The aluminum alloy of claim 23 in which said dispersoid-forming element is Mn and said dispersoid-forming element contains at least 2.06 wt. % Mn.

26. The aluminum alloy of claim 23 in which said dispersoid-forming element is Cr and said dispersoid-forming element contains at least 0.37 wt. % Cr.

27. The aluminum alloy of claim 23 in which said dispersoid-forming element is V and said dispersoid-forming element contains at least 0.2 wt. % V.

28. The aluminum alloy of claim 23 in which said dispersoid-forming element is Ti and said dispersoid-forming element contains at least 0.2 wt. % Ti.

29. The aluminum alloy of claim 23 in which said dispersoid-forming element is Hf and said dispersoid-forming element contains at least 0.2 wt. % Hf.

30. The aluminum alloy of claim 23 in which said dispersoid-forming element is Y and said dispersoid-forming element contains at least 0.16 wt. % Y.

31. The aluminum alloy of claim 23 in which said dispersoid-forming element is Nb and said dispersoid-forming element contains at least 0.16 wt. % Nb.

32. The aluminum alloy of claim 23 in which said dispersoid-forming element is Sc and said dispersoid-forming element contains at least 0.47 wt. % Sc.

* * * * *